US008037838B2

(12) United States Patent
Øigarden et al.

(10) Patent No.: US 8,037,838 B2
(45) Date of Patent: Oct. 18, 2011

(54) MOORING SYSTEM

(75) Inventors: Hans Øigarden, Oslo (NO); Karl Christian Strømsem, Oslo (NO); Fred Olsen, Oslo (NO)

(73) Assignee: Fobox AS, Oslo (NO)

( * ) Notice: Subject to any disclaimer, the term of this patent is extended or adjusted under 35 U.S.C. 154(b) by 181 days.

(21) Appl. No.: 12/161,133

(22) PCT Filed: Jan. 12, 2007

(86) PCT No.: PCT/NO2007/000014

§ 371 (c)(1),
(2), (4) Date: Oct. 21, 2008

(87) PCT Pub. No.: WO2007/081221

PCT Pub. Date: Jul. 19, 2007

(65) Prior Publication Data

US 2009/0107385 A1 Apr. 30, 2009

(30) Foreign Application Priority Data

Jan. 16, 2006 (NO) ..... 20060232

(51) Int. Cl.
*B63B 21/50* (2006.01)

(52) U.S. Cl. ..... 114/293; 114/230.1; 114/230.2

(58) Field of Classification Search ..... 114/230.1, 114/230.13, 230.14, 230.15, 230.2, 293, 114/294, 230.11; 405/169, 170, 171, 172, 405/224.2; 441/3, 4, 5

See application file for complete search history.

(56) References Cited

U.S. PATENT DOCUMENTS

| | | | | |
|---|---|---|---|---|
| 3,138,135 | A * | 6/1964 | Langer | 114/230.24 |
| 3,628,333 | A * | 12/1971 | Newton | 114/230.2 |
| 4,342,277 | A | 8/1982 | Sluys | |
| 5,054,415 | A * | 10/1991 | Marshall | 114/293 |
| 5,979,353 | A * | 11/1999 | Boerseth | 114/293 |
| 6,132,144 | A * | 10/2000 | Zueck et al. | 114/230.2 |
| 6,170,424 | B1 * | 1/2001 | Boerseth | 114/293 |
| 6,357,378 | B1 | 3/2002 | Hile | |
| 2005/0013666 | A1 | 1/2005 | Chianis et al. | |

FOREIGN PATENT DOCUMENTS

| | | |
|---|---|---|
| WO | WO 88 06999 | 9/1988 |
| WO | WO 95 22482 | 8/1995 |
| WO | WO 97 29943 | 8/1997 |
| WO | WO 2005 025978 | 3/2005 |

OTHER PUBLICATIONS

Search Report for Norwegian Patent Application No. 20060232, dated Aug. 15, 2006.
Search Report for Norwegian Patent Application No. 20060232, dated Apr. 2, 2008.
Lien, Egil, Entitled "Mooring of plastic rings—A novel escape proof net cage concept", SINTEF Fisheries and Aquaculture AS, Apr. 2005, pp. 1-20.

* cited by examiner

*Primary Examiner* — Lars A Olson
(74) *Attorney, Agent, or Firm* — Patterson & Sheridan, LLP

(57) ABSTRACT

Mooring system arranged in a body of water for the mooring of multiple surface or semi-submersible vessels or platforms with a artificial seafloor grid designed as a mesh-like structure arranged in a substantially horizontal plane in the body of water. The artificial seafloor grid including means for attachment to said vessel or platform, and is mechanically coupled to the bottom of the sea using anchoring elements.

9 Claims, 7 Drawing Sheets

MOORING SYSTEM

FIELD OF THE INVENTION

This invention relates generally to systems and methods for mooring floating structures such as floating vessels, platforms or rigs placed at sea.

More particularly this invention relates to a mooring system for removable mooring of one or more rigs, platforms or other floating vessels as part of a larger installation at an offshore location.

BACKGROUND OF THE INVENTION AND RELATED ART

Mooring systems are known in the prior art. In WO 97/29943 a mooring system is described which includes a bridle having a star-like shape that is useful for mooring a single vessel or for mooring two or more vessels relative to one another. The mooring system describes in WO 97/29943 has a mooring bridle formed of a plurality of anchor connections spaced about a central mooring position. The system includes connecting lines attached to non-adjacent anchor buoys and attachable to the additional vessel and includes mooring lines attachable to the additional vessel holding the vessel to the mooring bridle. The mooring lines each include an anchor (of the adjacent anchor connection), an anchor line, an anchor buoy, and a vessel line. In an alternative the system described in WO 97/29943 includes interconnecting two mooring bridles to provide for close, effective mooring of two vessels relative to one another.

U.S. Pat. No. 4,342,277 illustrates a system for anchoring a large number of interconnected mooring floats in either deep or shallow bodies of water. The system includes a grid of post-tensioned cables positioned beneath the floats and a number of anchoring lines extending between the grid and attachment fixtures forming part of the floats.

U.S. Pat. No. 5,704,307 illustrates a taut leg bow mooring system which includes an anchor positioned on the floor of the sea. A riser line is secured to and extends upwardly from the anchor, and a submerged buoy secured to the end of the riser line from the anchor.

It is limitation of all the above mentioned prior art solutions that even though a vessel may be connected to the mooring system in a removable fashion, all of the mooring structures rely on elements extending up to the surface of the sea, permanently situated at or near the surface of the sea when the mooring system has been positioned.

In the mooring system of WO 97/29943 the platform forms an integral part of the mooring grid, meaning that the mooring grid will at least partly collapse and alter shape and positions of many of its structural elements if the platform is removed. Hence this mooring grid does not allow for the removal of all surface components without loosing its form. On the one hand, system elements remaining on the surface may form an undesirable obstruction. On the other hand in a system where the surface elements are also removed, the mooring system changes shape and position, thereby making it difficult to restore to its desired operation.

The anchoring system for floating moorage disclosed in U.S. Pat. No. 4,342,277 needs several floats at the surface of the sea to remain intact. If these surface floats were removed the anchoring system would fall to the bottom of the sea and be very hard to reinstall into its original shape.

There is thus a need for a more flexible mooring system which improves the predictability of the mooring of surface vessels or the like, and which provides reduced a hindrance or restriction when there are no surface vessels or the like coupled to the mooring system.

Preferably, such a mooring system should enable the mooring of a number of platforms or vessels in at all depths in such a way that the mooring is able to withstand the forces typically occurring within such systems in such waters.

In some cases a mooring system should enable the mooring in shallow to deep waters of multiple platforms or vessels in substantially fixed positions relative to each other without resulting in excessive straining forces in any part of the system.

It is thus an object of the invention to provide a mooring system which allows improved freedom of movement for surface platforms or vessels while at the same time having a possibility of secure mooring of a vessel or platform at some location at or near a mooring point while taking into account variation in ocean floor shapes and depths.

SUMMARY OF THE INVENTION

In order to meet the objectives set forth above there is in one aspect of the invention provided a mooring system arranged in a body of water for the mooring of multiple surface or semi-submersible vessels or platforms wherein an artificial seafloor grid designed as a mesh like structure arranged in a substantially horizontal plane in the body of water. The artificial seafloor grid including means for attachment to said vessel or platform, and the seafloor grid is being mechanically coupled to the bottom of the sea using anchoring elements.

In one preferred embodiment of the mooring system according to the invention the mesh like structure comprises any number of substantially rectangular segments, adjacently arranged.

In one preferred embodiment of the mooring grid having substantially rectangular segments, the segments are defined by four elongated mooring grid members.

In a preferred embodiment of the mooring system according to the invention the artificial seafloor grid includes second means for attachment. The said second means for attachment is selectively attachable to at least one local mooring line member, whereby said local mooring line member is held in a substantially fixed position relative to said mooring grid.

In a further preferred embodiment of the mooring system according to the invention the bottom anchoring elements includes a third means for attachment. The third means for attachment is attachable to the substantially horizontally arranged artificial seafloor grid whereby said mooring grid is anchored to the bottom of the sea.

In a second aspect of the invention there is provided a mooring system for the mooring of multiple surface or semi-submersible vessels or platforms at sea comprising a multiple of local mooring line members, each including first means for attachment being selectively attachable to said vessel or platform. The mooring system is characteristic in that it comprises a artificial seafloor grid arranged in a body of water in a substantially horizontal fashion. The artificial seafloor grid also comprises second means for attachment being selectively attachable to at least one of said local mooring line members, whereby one of the local mooring line members is held in a substantially fixed position relative to the artificial seafloor grid. The mooring grid is anchorable to the bottom of the sea using anchoring elements.

In a preferred embodiment of the mooring system according to the second aspect of the invention the bottom anchoring elements comprises third means for attachment. The third means for attachment is attachable to the substantially horizontally arranged artificial seafloor grid whereby said mooring grid is anchored to the bottom of the sea.

In a further preferred embodiment of the mooring system according to the second aspect of the invention the third means for attachment comprises anchor line members, said anchor line member having two end sections, a first end section of the said anchor line member being attachable to said anchoring element and a second end of said anchor line member being attachable to said artificial seafloor grid.

In a yet further preferred embodiment of the mooring system according to the second aspect of the invention the artificial seafloor grid is arranged as one or more grid segments of substantially rectangular shape, where each grid segment is formed by four connected mooring grid members.

In a third aspect of the invention a method for mooring a surface or semi-submersible vessel or platform at sea has been developed, the method comprising the steps of anchoring an artificial seafloor grid to the seabed, whereby the artificial seafloor grid establishes a number of docking positions for a vessel or platform. Further at least one vessel or platform is mechanically coupled or connected to at least one of said docking positions.

DETAILED DESCRIPTION OF PREFERRED EMBODIMENTS

Figure 1A:
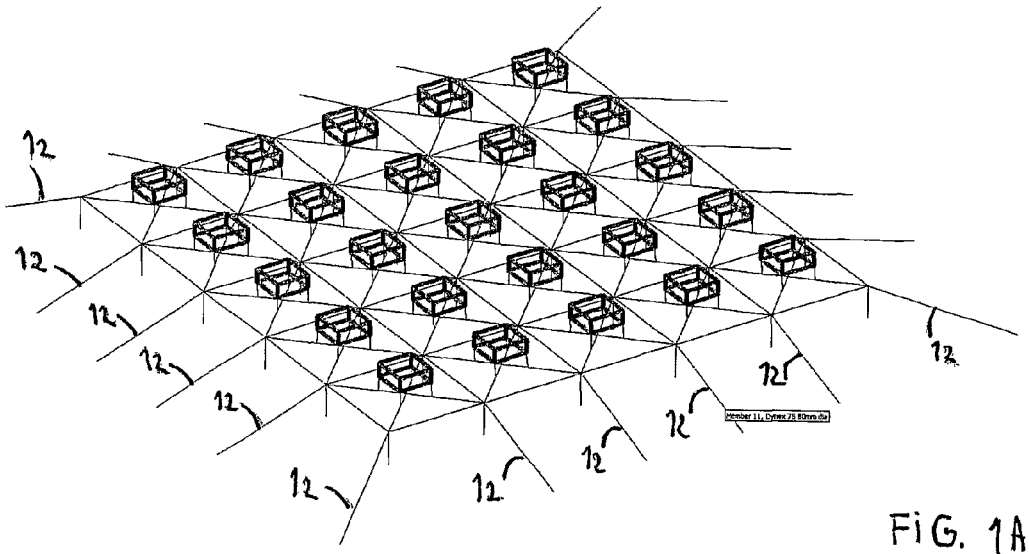
FIGS. 1A-1B illustrate one embodiment of a mooring system according to the invention for accommodating a number of platforms in which diagonal line members in an artificial seafloor grid are coupled to platforms using local mooring lines running vertically from the platform down to the diagonal line members.
Figure 1B:
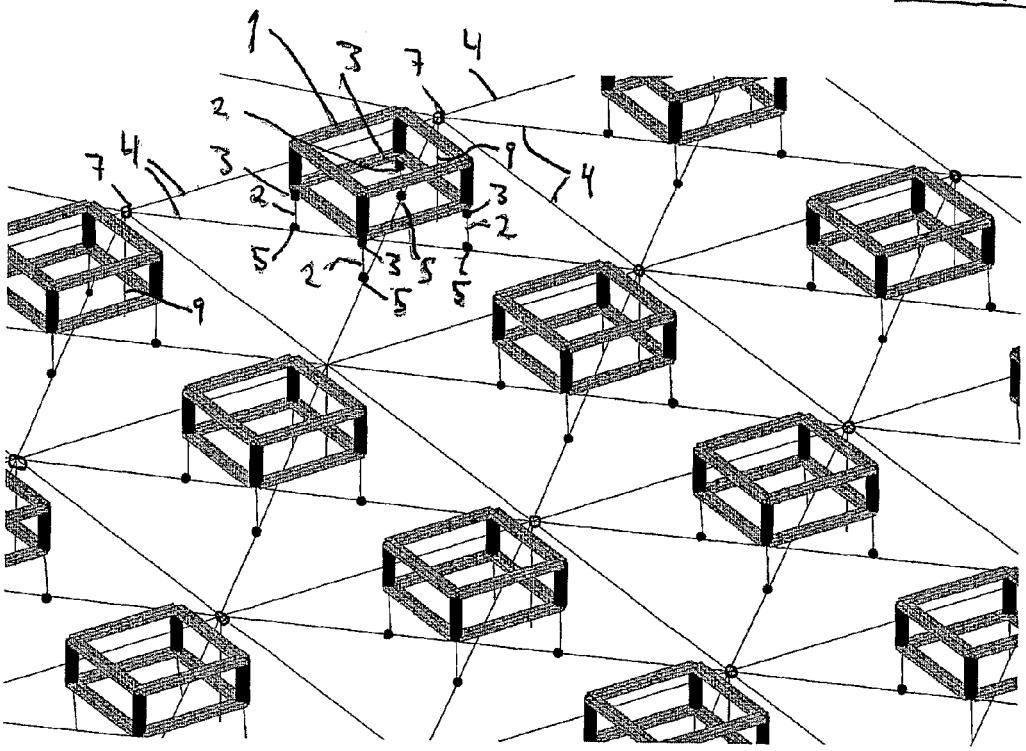

FIGS. 1A and 1B illustrate one embodiment of a mooring system according to the invention for mooring a surface or semi-submersible vessel or platform 1 at sea. In the context of this application the expression sea is intended to encompass ocean environments as well as inland saltwater or freshwater lake or fiord environments. FIG. 1A illustrate the complete assembly of mooring points in the mooring system, while FIG. 1B illustrates a section of the mooring system of FIG. 1A. Although the word platform will be used here, a platform may be equivalent to any floating structure, such as a vessel, a wave vessel, a rig or a rig station which is an autonomous structure or a part of a larger installation or structure installed at, or intended for, an offshore environment or location, for example in connection with the exploration of hydrocarbon reservoirs below the seabed, or in connection with any other similar activity in an aqueous environment, either at offshore or inland locations. Mooring line members 2 are at one end attachable, preferably in a removable fashion, to a vessel or platform, typically to a lower deck of a platform, using a first means for attachment 3. The first means for attachment 3 may for example be in the form of a suitable combination of shackles and eyes, at least one of which is connected to the platform. Any person of ordinary skill in the art will understand that the shackles and eyes combination may have a number of different configurations. The mooring line members 2 could in some configurations be attached, possibly removably, to another deck of a platform or rig, or at any location on the platform found suitable for the rig or vessel to be moored, depending on stability requirements. The mooring line members 2 attachable to the vessel or platform are in this description referred to as local mooring line members 2, indicating that they are local to the vessel or platform 1. In an alternative, the mooring line members 2 could be replaced by substantially vertically arranged mooring tethers attachable at a first end to the artificial sea floor grid 4 and attachable at a second end section to a vessel or platform like structure.

At the other end, opposite to the platform or vessel end, the mooring line members or mooring tethers are attachable to the artificial seafloor grid 4 using a second means for attachment 5. The second means for attachment 5 are adapted for connecting, possibly removably, one end of a local mooring line member 2 to the artificial seafloor grid 4. The second means for attachment 5 may for example be in the form of a suitably combination of properly dimensioned shackles and eyes.

Regarding the local mooring line member 2, two alternatives are possible. In one alternative the platform or vessel is provided with and carries a set of local mooring line members 2 when it is to be coupled into the mooring system. In this alternative, the local mooring line members 2 are lowered into the sea when the vessel or platform is roughly in its right position. When the lower end of a local mooring line member 2 has reached the depth of the substantially horizontal lines of the artificial seafloor grid 4, the local mooring line member 2 is mechanically coupled to the artificial seafloor grid at the connection points using a suitable coupling means, for example a combination of shackles and eyes.

The artificial seafloor grid 4 comprises a number of interconnected lines or wires in a grid like arrangement in a body of water 20. The artificial seafloor grid 4 is typically adapted to form a substantially horizontal main grid, that is a main grid comprising a number of lines or wires forming a grid of substantially rectangular segments in a substantially horizontal plane parallel to the surface of the sea, when platforms or other buoyancy-contributing elements are attached to the main grid thereby pulling or holding the grid in its normal position in the water. The main grid could in principle be adapted to be arranged near or almost on the seafloor. When no buoyancy-elements are attached to the main grid, the main grid would typically sink to the ocean floor, thereby creating a minimum of obstruction to surface vessels or surface rigs being moved on the sea surface.

The second means for attachment 5 ensures that the local mooring line members 2 at one end are arranged in a substantially fixed position relative to the mooring grid 4. In the embodiment of the invention illustrated in FIGS. 1A and 1B, the local mooring line members 2 are arranged in a substantially vertical fashion in the water. Further the artificial seafloor grid 4 is arranged in a substantially rectangular form, where each of the anchor line members 9 are connected to one corresponding corner of the substantially rectangular artificial seafloor grid section. Included in the artificial seafloor grid are diagonal lines running between opposite corners of the substantially rectangular shaped sections of the artificial seafloor grid 4. The local mooring line members 2 or mooring tethers are connected, possibly in an attachable fashion, to the artificial seafloor grid 4 at some position along the diagonal lines of the artificial seafloor grid. Hence the second means for attachment may either be an integrated part of the end of the local mooring line members 2, an integrated part of the mooring grid 4, or both.

The bottom anchor elements 6 are placed in or on the seabed 8 and connected, possibly in an attachable fashion, to the artificial seafloor grid 4 using third means for attachment 7, possibly with anchor line members 9. The first means for attachment 3 may for example be in the form of a suitable combination of shackles and eyes. Further, the third means for attachment 7 are adapted for attaching the artificial seafloor grid 4 to the bottom anchor line members 6. If the third means for attachment 7 includes anchor line members 9, the anchor line members 9 will at one end be attachable to the artificial seafloor grid 4 and at the opposite end be attachable to the bottom anchor elements 6.

The third means for attachment 7 may be considered to be an integrated part of the mooring grid 4, an integrated part of the bottom anchor elements 6, an integrated part of the anchor line members 9, or a combination of these.

Figure 2A:
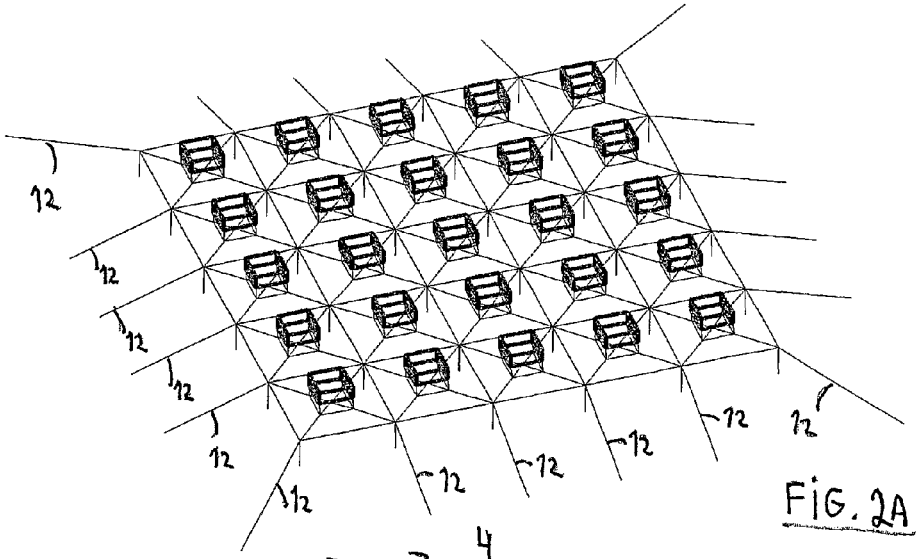
FIGS. 2A-2B illustrate a version of the mooring system of FIGS. 1A-1B according to the invention where substantially horizontal auxiliary lines connect adjacent ends of the local mooring lines of each platform.
Figure 2B:
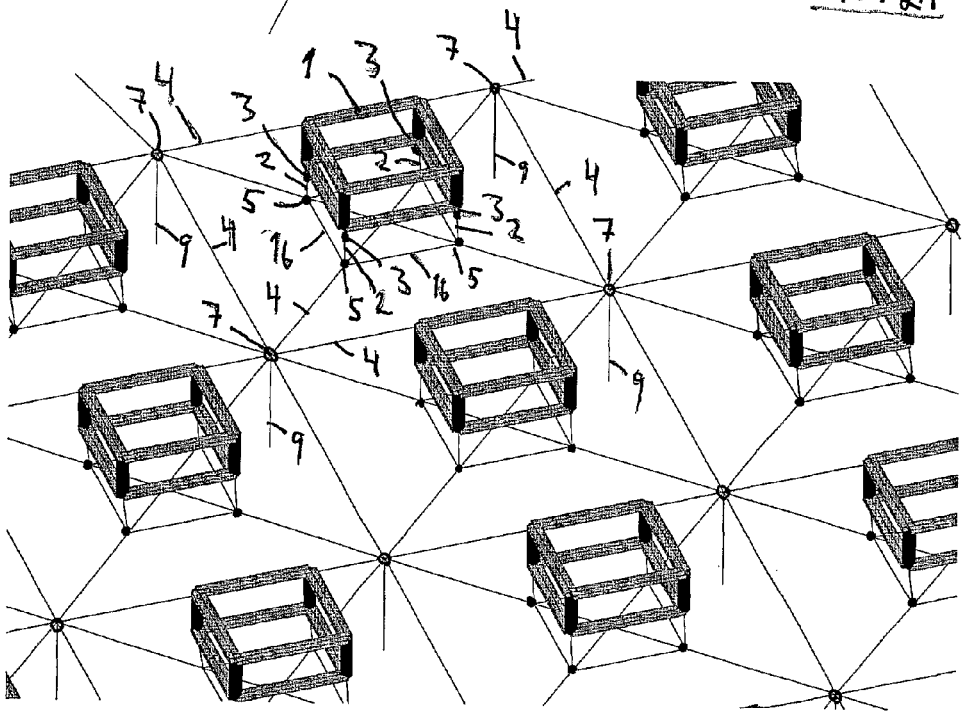

FIGS. 2A and 2B illustrate an alternative embodiment of a mooring system according to the invention wherein additional auxiliary horizontal lines or elements 16 are connected between pairs of adjacent second attachment means 5, thereby forming additional support members for the substantially horizontal artificial seafloor grid 4. As with FIGS. 1A and 1B, FIG. 2A illustrates a complete mooring system having platforms connected at all mooring positions, while FIG. 2B illustrate a section of the mooring system of FIG. 2A.

Figure 3A:
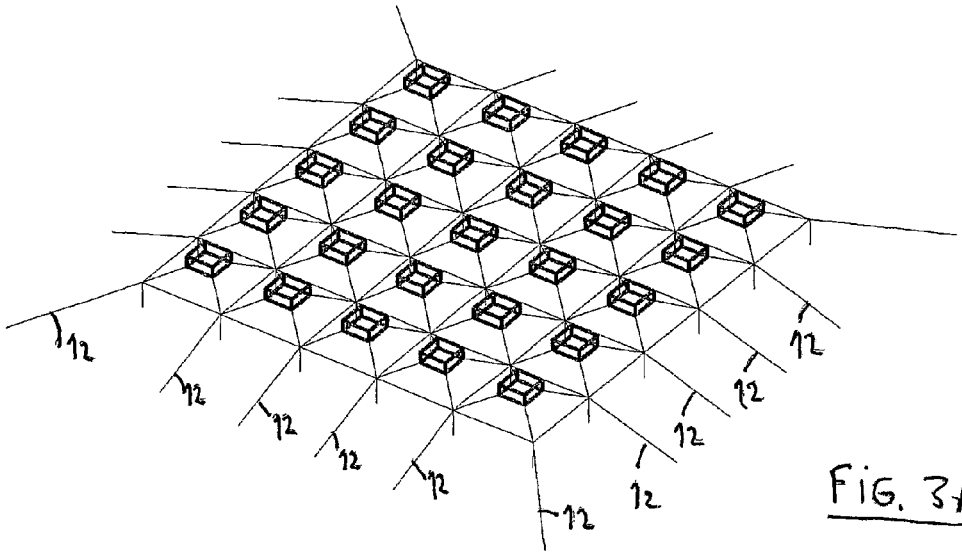
FIG. 3A-3B illustrates of one embodiment of a mooring system according to the invention wherein substantially horizontally arranged line members are interconnected to define rectangular segments in a substantially horizontally arranged artificial seafloor grid, and the local mooring lines are connected in the artificial seafloor grid at the corners of such a rectangular segment.
Figure 3B:
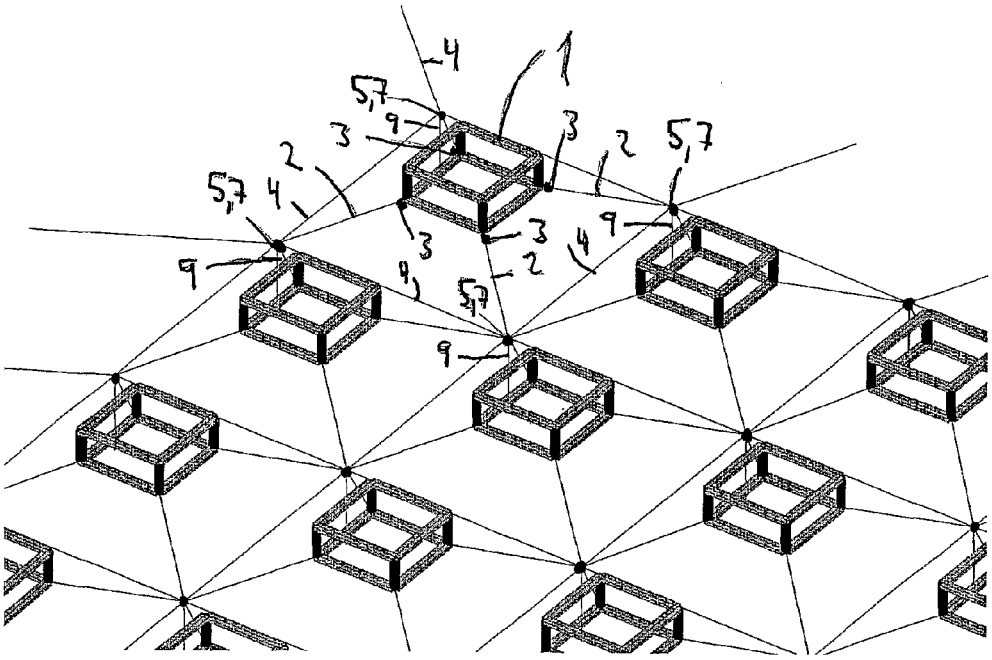

FIGS. 3A and 3B illustrate yet another alternative embodiment of a mooring system according to the invention for mooring a surface or semi-submersible vessel or platform 1 at sea. Again, as with FIGS. 1A and 1B, FIG. 3A illustrates a complete mooring system having platforms connected at all mooring positions, while FIG. 3B illustrate a section of the mooring system of FIG. 3A.

In this example the artificial seafloor grid 4 is also substantially horizontally arranged in the water in the form of a substantially rectangular section. At each corner of the substantially rectangular section of the artificial seafloor grid 4, local mooring line members 2 as well as anchor line members 9 are connected, possibly in an attachable fashion. Hence both the second attachment 5 means and the third attachment means 7 are at least partially located at the corners of the artificial seafloor grid 4, and may be combined into a single attachment unit arranged at each corner of the artificial seafloor grid 4. In the various embodiments of the invention the lines of the artificial seafloor grid, the local mooring lines and the anchoring lines could be of Nylon® rope type. Other types of lines could be envisaged by anyone of ordinary skill in the art, for Dyneema® based fibers supplied by DSM Dyneema is at present one alternative. It has been found by this inventor(s) that Nylon® ropes have a flexibility which gives good stability to the total moored structure.

Figure 4A:
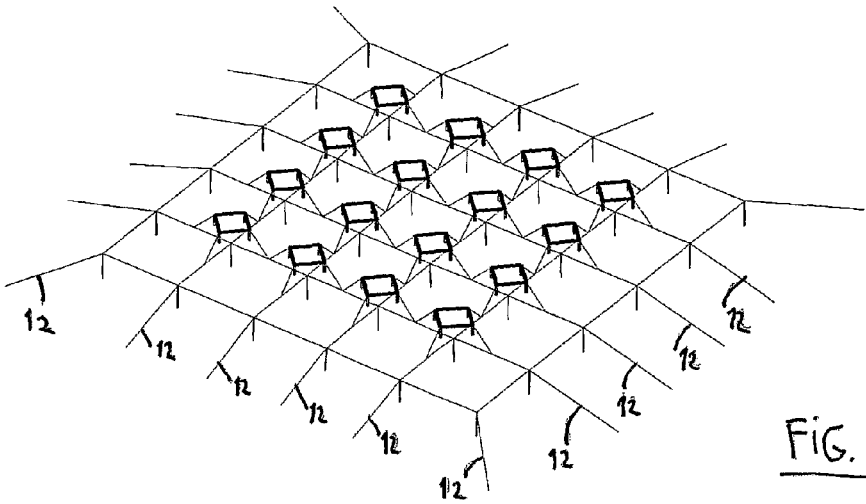
FIGS. 4A-4B illustrate another embodiment of a mooring system according to the invention wherein substantially horizontally arranged line members are interconnected to define rectangular segments in a substantially horizontally arranged artificial seafloor grid, wherein each local mooring line at one end connect to a corner of an upper part, for example an upper deck, of a platform and the other end connect to a line defining a side in one of said rectangular segments.
Figure 4B:
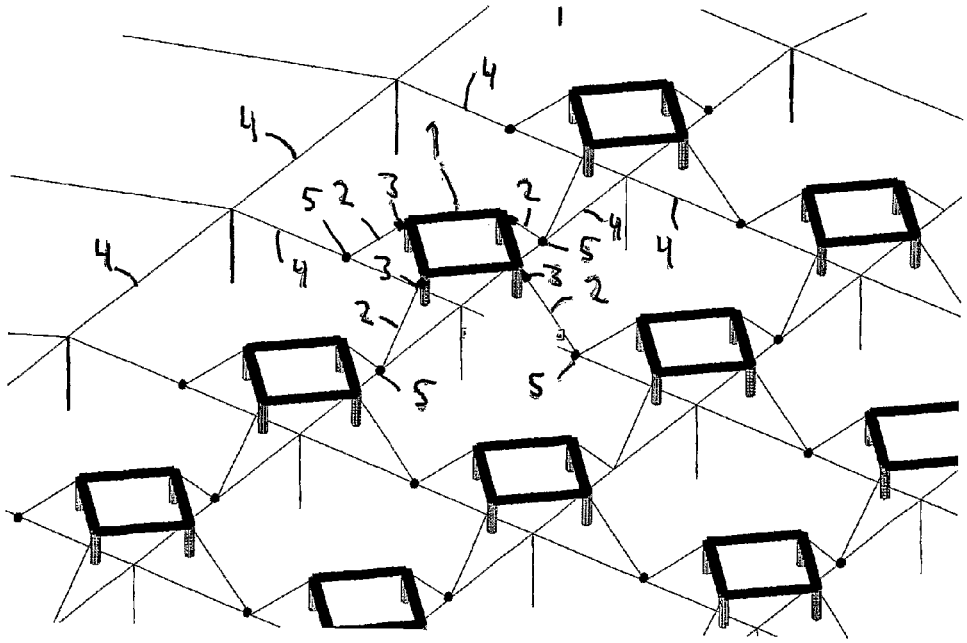

FIGS. 4A and 4B illustrate still another alternative embodiment of a mooring system according to the invention for mooring a surface or semi-submersible vessel or platform 1 at sea. And again, as with FIGS. 1A and 1B, FIG. 4A illustrates a complete mooring system having platforms connected at all mooring positions, while FIG. 4B illustrate a section of the mooring system of FIG. 4A. In this embodiment the artificial seafloor grid 4 comprises a first set of parallel lines arranged in an evenly spaced manner in one direction and a second set of parallel lines arranged in an evenly spaced manner in a second direction. Preferably the second set of lines is perpendicular to the first set of lines, thus creating a set of rectangular sections in the grid, the corners of which are defined by the places where a line in one direction crosses a line in the other direction. In this embodiment local mooring lines 2 are coupled somewhere between two adjacent corners of a rectangular section, preferably about midway between two adjacent crossing points of the lines. In this way a platform or vessel can be placed roughly right above a crossing point of two perpendicular lines, while a set of four local mooring lines 2 may be connected to the platform, extend in different directions away from the platform connecting to a line running between two corners of a rectangle formed by the grid.

The various illustrated embodiments of the invention shows a configuration of the mooring system where the local mooring line members 2 effectively prevents the platform or vessel 1 from drifting off, i.e. the platform is kept within a defined space, while still allowing a first order motion of the platform or vessel 1.

In the embodiments of the invention illustrated in FIGS. 1A,1B,2A,2B,3A,3C,4A,4B the artificial seafloor grid 4 has effectively one platform or vessel 1 per segment of the grid. As the platform or vessel 1 occupies a smaller surface area than the surface area of each segment of the grid, the platforms or vessels 1 may be located to ensure a sufficient safety distance between the platforms or vessels 1.

Figure 5A:
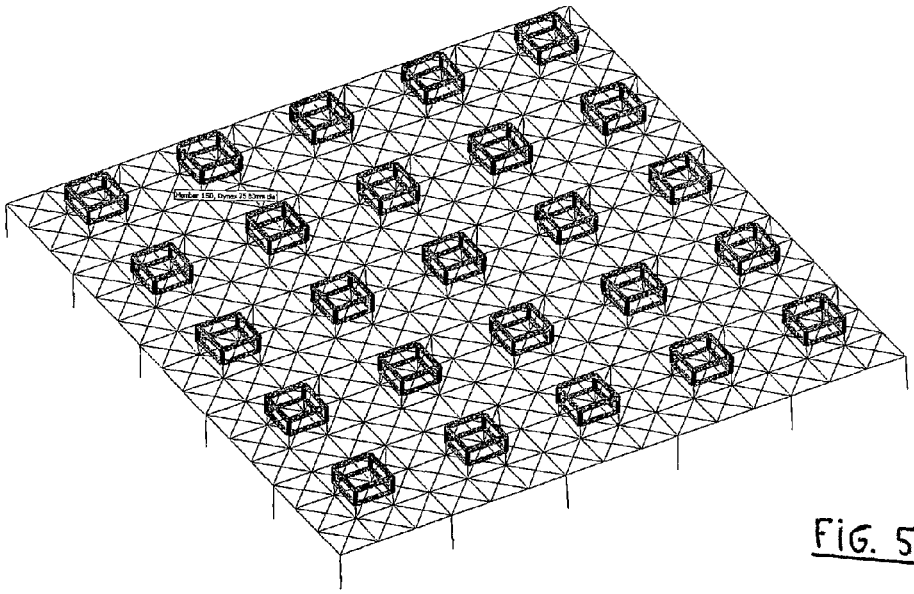
FIGS. 5A-5B illustrates another embodiment of a mooring system according to the invention wherein the artificial seafloor grid comprises a grid of rectangular segments wherein one platform is moored to the rectangular segment in the middle rectangle in a section of three-by-three rectangular segments.
Figure 5B:
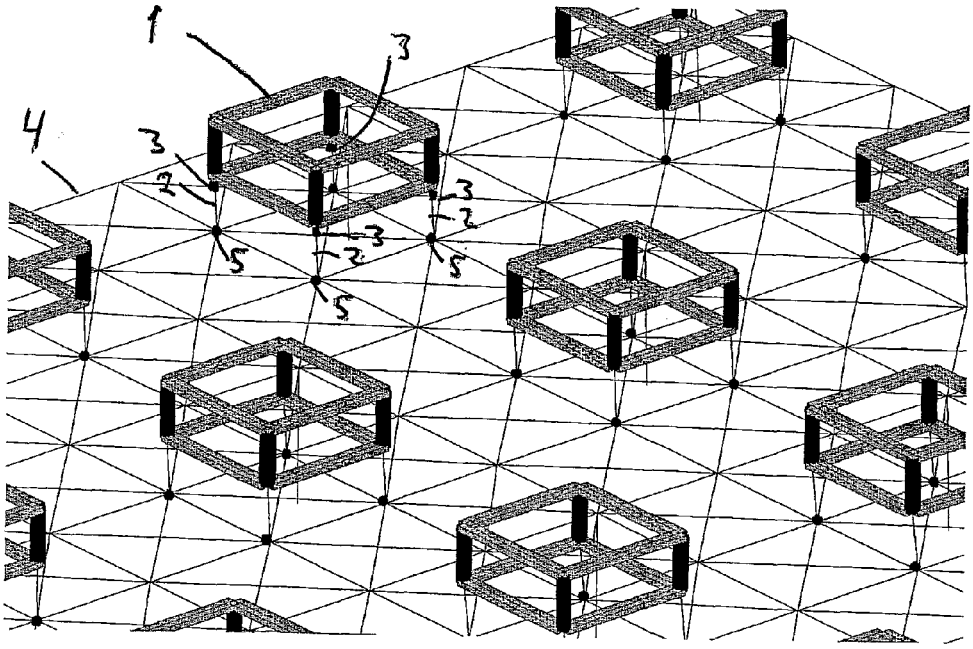

In an alternative embodiment an even larger safety distance between the platforms or vessel may be ensured. In the alternative embodiment of the mooring system according to the invention illustrated in FIGS. 5A and 5B an artificial seafloor grid 4 is arranged to form a grid of substantially rectangular segments, where lines are arranged along each set of diagonals of the rectangular segments in such a way that each rectangular segment is divided into four triangular subsegments.

Each 3×3 assembly of adjacent segments defines one platform or vessel connection point, where a platform or vessel may be connected to the corners or the centre segment of each 3×3 assembly. When a platform or vessel 1 is connected to the centre segment of the 3×3 assembly of segments while the remaining segments are free, that is they have no platform or vessel connected to them, a separation of the platforms or vessels 1 is obtained the free segments.

Figure 6:
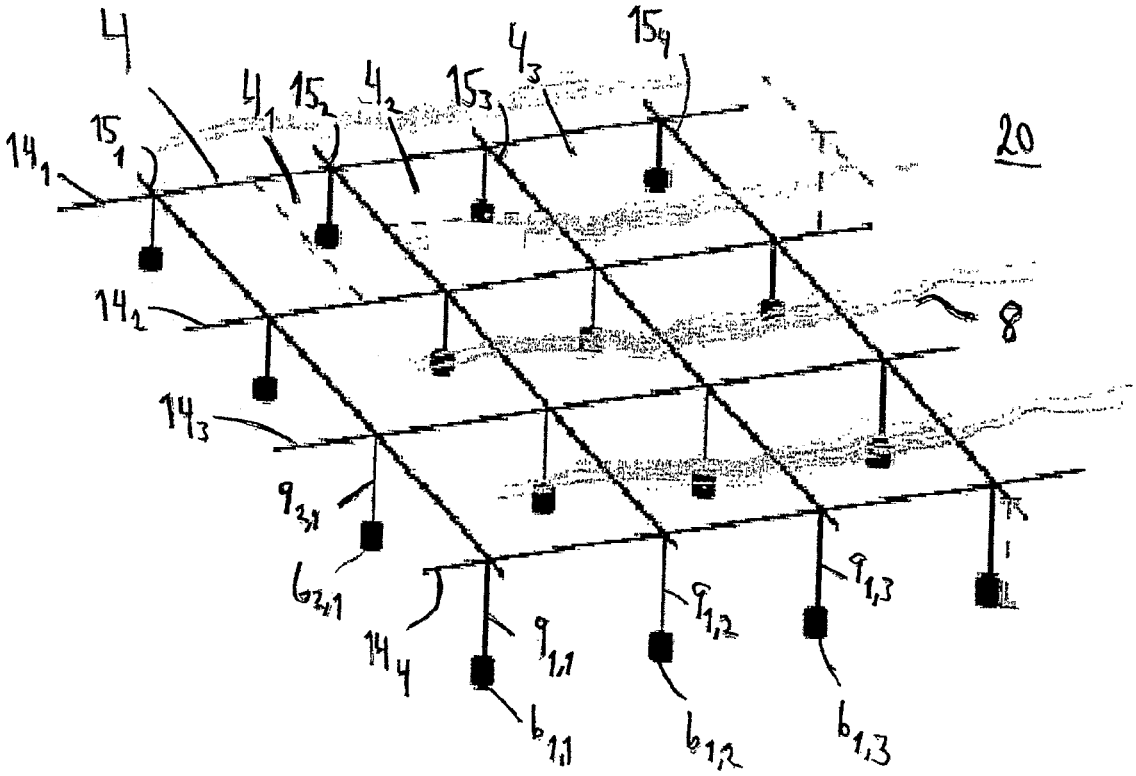
FIG. 6 illustrate the anchoring of the artificial seafloor grid to the sea bottom, where anchor line members extend from a substantially horizontal main grid and down to bottom anchor elements.

FIG. 6 illustrates how each substantially rectangular segment of the artificial seafloor grid 4 is connected, possibly in an attachable fashion, to at least one bottom anchor element $\mathbf{6}_{n,m}$ using at least one anchor line member $\mathbf{9}_{n,m}$ (n, m=1, 2, 3, or 4), for example at each corner of the segment. The bottom anchors $\mathbf{6}_{n,m}$ which is intended to fix the mooring system to the seabed could be suction anchors, concrete anchors or a combination of several anchor types, depending on the surface conditions. As mentioned in United States Patent Application no. 2005201835 it is known to use closed caissons, piles and gravity bases (massive ballast filled slab-form structures of steel or reinforced concrete) as seabed anchors or foundations. However, when the seabed soil conditions permit, anchors and foundation structures are preferably embedded in the seabed, either by evacuation of the interior of a hollow anchor placed upright on the seabed with its open end resting on the seabed, or by mechanically driving an the anchor into the seabed for example by application of a vibratory mechanism or by repeated application of a hammer ("pile driving" technique). At great sea depths the use of hollow anchors is preferable since the seabed soil conditions are generally soft.

The artificial seafloor grid 4 could be described as a mesh-like structure arranged in a substantially horizontal plane, in practice this horizontal plane will be lying substantially parallel to a surface of the sea, at a certain depth below the surface. The mesh is constructed from a first set of elongated main grid members $\mathbf{14}_n$ arranged in parallel in one direction crossed by a second set of similar elongated main grid members $\mathbf{15}_n$ also arranged in parallel, the first and second set of main grid members being arranged in substantially the same horizontal plane. Typically the main grid members are connected, perhaps in a detachable manner at the points of crossing each other. At the edge of the mesh the main grid members extend some distance out from the mesh and may continue outwardly and downwardly towards a bottom anchor, perhaps extending all the way out and down to the location of the bottom anchor. Even though the Figures illustrate a somewhat ideal situation where the seabed is almost flat, the system is well suited for use in places where there is an irregular seabed, i.e. with varying depths across the region of the artificial seafloor grid 4. In this case the lengths of the lines may have to be individually adjusted for each anchor element 6 to accommodate for the varying depth.

The artificial seafloor grid 4 being a part of the mooring system according to the invention makes it possible to attach a number of platforms/vessels/rigs/stations 1 to a common artificial seafloor grid 4. With suitable dimensioning of the rectangular segments of the artificial seafloor grid 4 and by avoiding occupying all rectangular segments of the artificial seafloor grid 4, it may be possible to allow for the replacement of any of the platforms/vessels/rigs/stations connected to the artificial seafloor grid 4 at any time after the system has been installed at an offshore location. The artificial seafloor grid 4 ensures that each individual platform/rig 1 is held in one position and in a safe distance from the position of other platforms/rigs 1.

Figure 7:
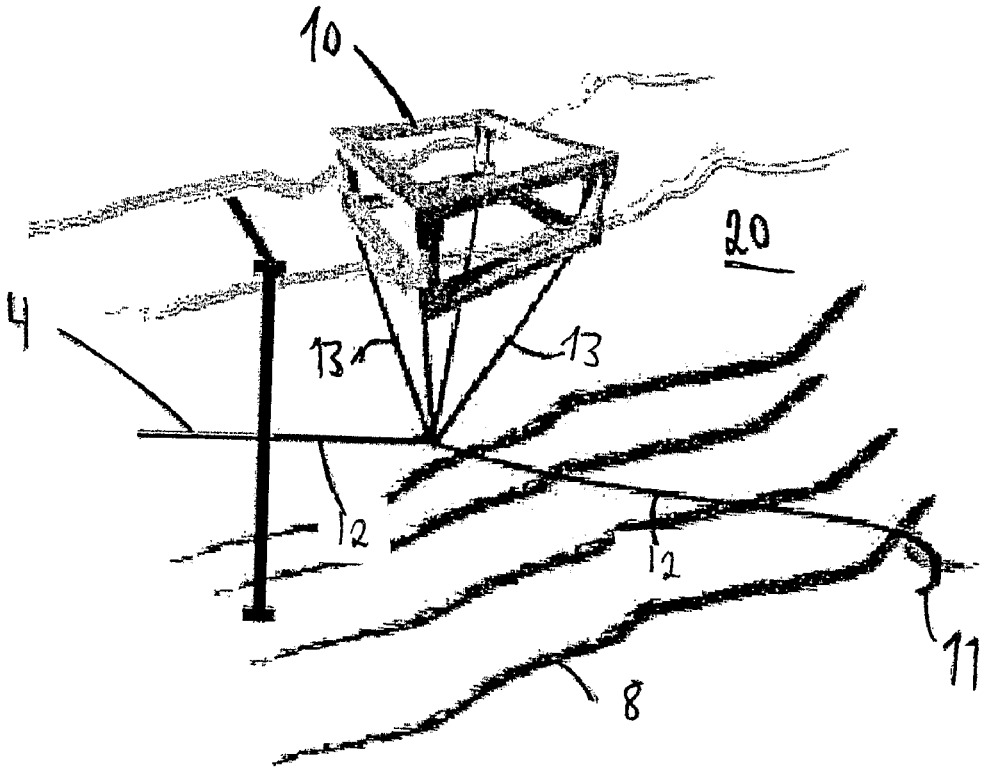
FIG. 7 illustrates an end section of the artificial seafloor grid, illustrating how an end mooring unit in the form of a floating buoy is chained to an anchor at the seabed.

FIGS. 1A,1B,2A,2B,3A,3C,4A,4B illustrate how end mooring grid members 12 extend outwardly from a main part of the artificial seafloor grid 4. FIG. 7 illustrates how the end mooring grid members 12 extend out to and connect to an end mooring unit 10 and to an end mooring anchor 11. The end mooring grid members 12 are typically lines or tethers. The end mooring grid members 12 typically connects to the end mooring units 10 via end unit connecting lines 13.

FIG. 7 illustrates a typical end mooring configuration using a buoyant platform or vessel as the end mooring unit 10. As an alternative, the end mooring unit could be a tower structure or framework installed on the sea bottom. Each end mooring unit 10 is connected, possibly in an attachable fashion, to an end mooring grid member 12, via end unit connecting lines 13.

In more detail, each end mooring unit 10 may be connected to an end mooring grid member 12 using four end unit connecting lines 13, each of the lines 13 being connected at one end to the platform 1, and at the other end to the end mooring grid member 12. The end mooring grid member 12 is at one end connected to an anchor 11, which may be an anchor of the conventional type, while at the other end being connected to the artificial seafloor grid 4. The choice and design of the anchor 11 may depend on the conditions of the local sea bed and will typically be determined during detailed design for a specific location.

Preferably, the end mooring units 10 could be in the form of buoys or subsea towers, but could also be in the form of semi-submersible units having some amount of buoyancy.

The end mooring units or stations 10 ensures that the total mooring system is kept in place. The end mooring units 10 also ensures that the horizontal forces in the main grid are transferred to the sea bed in a controlled manner.

In the mooring system configurations according to the invention static and quasi-static forces will to a significant extent be transferred in a balanced way to the anchors at the grid edges and via the lines and/or tethers to the bottom anchors. Simulations performed by the present inventors have demonstrated that relative motion between the platforms/rigs in such configurations system will be de-coupled to a significant extent, whereby the risk of snap loads is reduced.

The mooring system according to the invention provides a number of adjacent and similar attachment positions for a platform, rig or the like. The attachment positions, i.e. the anchoring locations are predefined by the arrangement of the artificial seafloor grid. Hence, this mooring system according to the invention provides an operator with the possibility of positioning a platform in a number of different positions, where the attachment is performed in a substantially identical manner in each position. This way the use of many different types of anchors is also avoided when the mooring system has been arranged.

The mooring system according to the invention can be arranged with its artificial seafloor grid at any depth between the seafloor and the surface of the sea by providing the appropriate lengths of local mooring line members 2 and anchor line members 9.

Further, the mooring system according to this invention is particularly well suited to the positioning of a number of power generating platforms having generators driven by the wave-power. In such a power generating system it will particularly beneficial to be able to remove any number of platforms, e.g. for service purposes, while maintaining optimum freedom of movement for vessels or structures at surface level.

The present invention is suited to applications within the field of offshore oil and gas exploration and related installations. However, the present invention can also be used to securely arrange a number of seabased floating windmills, or equally well for fixing a fish farm installation at sea.

The invention claimed is:

1. A mooring system arranged in a body of water for the mooring of multiple surface or semi-submersible vessels or platforms at sea, comprising:

an artificial seafloor grid designed as a mesh structure arranged in a substantially horizontal plane in the body of water, said artificial seafloor grid including an attachment member to attach to said vessel or platform, said artificial seafloor grid being mechanically coupled to the bottom of the sea using anchoring elements, and said artificial seafloor grid including a plurality of adjacent grid members in at least two directions such that the grid members cross each other to form an intersection, said two directions including at least two grid members;

at least one mooring line attached at a first end to said vessel or platform and at a second end to the artificial seafloor grid; and a plurality of seabed anchoring lines, wherein at least one anchoring line is attached at a first end to at least one intersection between the grid members and at a second end to at least one seabed anchor.

2. The mooring system according to claim 1, wherein said mesh structure comprises any number of substantially rectangular segments, adjacently arranged.

3. The mooring system according to claim 2, wherein said segments is defined by four elongated grid members.

4. The mooring system according to claim 1, wherein the artificial seafloor grid includes a plurality of mooring lines, each vessel mooring line including a first attachment member and a second attachment member, said first attachment member being selectively attachable to a vessel or platform, said second attachment member being selectively attachable to the artificial seafloor grid, whereby said mooring line is held in a substantially fixed position relative to said artificial seafloor grid.

5. The mooring system according to claim 1, wherein said seabed anchor includes a third attachment member, said third attachment member being attachable to the artificial seafloor grid via at least one seabed anchoring line, whereby said artificial seafloor grid is anchored to the seabed.

6. The mooring system according to claim 1, wherein said artificial seafloor grid is arranged as one or more grid segments of substantially rectangular shape, where each grid segment is formed by four connected grid members.

7. A method for mooring a surface or semi-submersible vessel or platform at sea, comprising the steps of:

anchoring an artificial seafloor grid designed as a mesh structure arranged in a substantially horizontal plane in the body of water, said artificial seafloor grid including an attachment member to attach to said vessel or platform, said artificial seafloor grid being mechanically coupled to the bottom of the sea by anchoring elements, said artificial seafloor grid including a plurality of adjacent grid members arranged in at least two directions such that the grid members cross each other to form an intersection, said two directions including at least two grid members, the artificial seafloor grid establishing a number of docking positions for said vessel or platform;

mechanically coupling the artificial seafloor grid to the bottom of the sea using anchoring lines, wherein at least one anchoring line is attached at a first end to at least one intersection between the grid members and at a second end to at least one anchoring element; and mechanically coupling at least one vessel or platform to at least one of said docking positions.

8. The mooring system of claim 1, wherein at least one end anchoring line is attached at a first end to an end of the mesh structure, and is attached at a second end to a seabed anchor.

9. The mooring system of claim 1, wherein the at least one mooring line is attached at the second end to the artificial seafloor grid at a point between intersections of the grid members.

* * * * *

UNITED STATES PATENT AND TRADEMARK OFFICE

CERTIFICATE OF CORRECTION

PATENT NO. : 8,037,838 B2
APPLICATION NO. : 12/161133
DATED : October 18, 2011
INVENTOR(S) : Øigarden et al It is certified that error appears in the above-identified patent and that said Letters Patent is hereby corrected as shown below:

In the Claims:

Column 9, Claim 4, Line 15, please delete "vessel".

Signed and Sealed this
Thirteenth Day of March, 2012

David J. Kappos

David J. Kappos
*Director of the United States Patent and Trademark Office*